United States Patent [19]

Yamamoto

[11] 4,325,215

[45] Apr. 20, 1982

[54] HYDRAULIC APPARATUS

[75] Inventor: Toru Yamamoto, Gifu, Japan

[73] Assignees: Teijin Seiki Company Limited, Osaka; Toyota Jidosha Kogyo Kabushiki Kaisha, Toyota, both of Japan

[21] Appl. No.: 127,138

[22] Filed: Mar. 4, 1980

Related U.S. Application Data

[63] Continuation-in-part of Ser. No. 885,342, Mar. 10, 1978, abandoned.

[30] Foreign Application Priority Data

Mar. 10, 1977 [JP] Japan ..... 52-26388

[51] Int. Cl.[3] ..... F16D 31/02; F04B 49/00

[52] U.S. Cl. ..... 60/450; 417/220

[58] Field of Search ..... 417/218-222; 60/445, 451, 452, 450

[56] References Cited

U.S. PATENT DOCUMENTS

| | | | |
|---|---|---|---|
| 2,472,477 | 6/1949 | Harrington et al. | 417/218 X |
| 2,552,604 | 5/1951 | Thoma | 417/218 X |
| 2,936,588 | 5/1960 | Gerpen | 417/218 |
| 2,938,469 | 5/1960 | Lauck | 417/220 X |
| 3,186,170 | 6/1965 | Gauthier et al. | 60/451 |
| 3,429,123 | 2/1969 | Burroughs | 60/451 |
| 4,077,744 | 3/1978 | Pensa | 417/218 |
| 4,259,039 | 3/1981 | Arnold | 417/220 |

FOREIGN PATENT DOCUMENTS

| | | | |
|---|---|---|---|
| 2363480 | 6/1975 | Fed. Rep. of Germany | 417/221 |

*Primary Examiner*—Carlton R. Croyle
*Assistant Examiner*—Edward Look
*Attorney, Agent, or Firm*—Cushman, Darby & Cushman

[57] ABSTRACT

A hydraulic apparatus for changing flow rate by displacing the flow rate changing member of a variable displacement hydraulic pump accommodated in a casing for eliminating any surplus and leaked oil and diminished kinetic energy loss comprises an actuator, a flow rate control valve, a resilient member accommodated in the casing to urge the flow rate changing member toward the direction where the flow rate of the hydraulic pump is increased, first and second sliding members slidably received in first and second cylinder chambers, respectively, provided in the casing to urge the flow rate changing member toward the direction where the flow rate of the hydraulic pump is decreased, a first fluid conduit having one end connected with an outward port of the hydraulic pump and the other end connected with a rear port of the actuator, a second fluid conduit having one end connected with a fore port of the actuator and the other end connected with an inlet port of the hydraulic pump through the flow rate control valve, a third fluid conduit having one end connected with the second fluid conduit and the other end connected with the first cylinder chamber, and a fourth fluid conduit having one end connected with the first fluid conduit and the other end connected with the second cylinder chamber.

7 Claims, 4 Drawing Figures

HYDRAULIC APPARATUS

This application is a continuation-in-part of my copending application bearing Ser. No. 885,342 filed Mar. 10, 1978, now abandoned.

This invention relates to a hydraulic apparatus and more particularly to a load sensitive type hydraulic apparatus which can operate an actuator at a constant speed against a load fluctuatedly acted on the actuator during cutting operation of a cutting mechanism and which can generate hydraulic pressure somewhat larger than that required for the load in response to the load fluctuation thereof.

Conventionally, there have been proposed a variety of hydraulic apparatuses such as for example those having hydraulic circuits assembled with a meter-out circuit or a bleed-off circuit in order to feed a pressure oil to an actuator from a hydraulic pump for operation of the actuator at a constant speed. However, each of those hydraulic apparatuses entailed a large amount of surplus pressure oil as well as a great deal of leaked oil, which resulted in kinetic loss to the hydraulic apparatus. Moreover, such kinetic loss is approximately changed into heat energy and thus brings about temperature increase of the pressure oil. An object of the present invention is to eliminate such drawbacks inherent in the prior art apparatus and to provide a hydraulic apparatus without any surplus and leaked oil to diminish kinetic loss to a lowest level.

In accordance with the present invention, there will be provided to accomplish such an object a hydraulic apparatus for changing flow rate by displacing a flow rate changing member of a variable displacement hydraulic pump accommodated in a casing, comprising in combination: an actuator; a flow rate control valve; a resilient member accommodated in the casing to urge the flow rate changing member toward the direction where the flow rate of the hydraulic pump is increased; a first sliding member slidably received in a first cylinder chamber provided in the casing to urge the flow rate changing member toward the direction where the flow rate of the hydraulic pump is decreased; a second sliding member slidably received in a second cylinder chamber provided in the casing to urge the flow rate changing member toward the direction where the flow rate of the hydraulic pump is decreased; a first conduit having one end connected with an outlet port of the hydraulic pump and the other end connected with a rear port of the actuator; a second fluid conduit having one end connected with a fore port of the actuator and the other end connected with one of the flow control valve; a third fluid conduit having one end connected with the remaining port of the flow control valve and the other end connected with an inlet port of the hydraulic pump; a fourth fluid conduit having one end connected with the second fluid conduit and the other end connected with the first cylinder chamber; and a fifth fluid conduit having one end connected with the first fluid conduit and the other end connected with the second cylinder chamber.

The above and other objects, features and advantages of the present invention will become clear from the following particular description of the invention and the appended claims, taken in conjunction with the accompanying drawings which show by way of example a preferred embodiment of the present invention.

Figure 1:
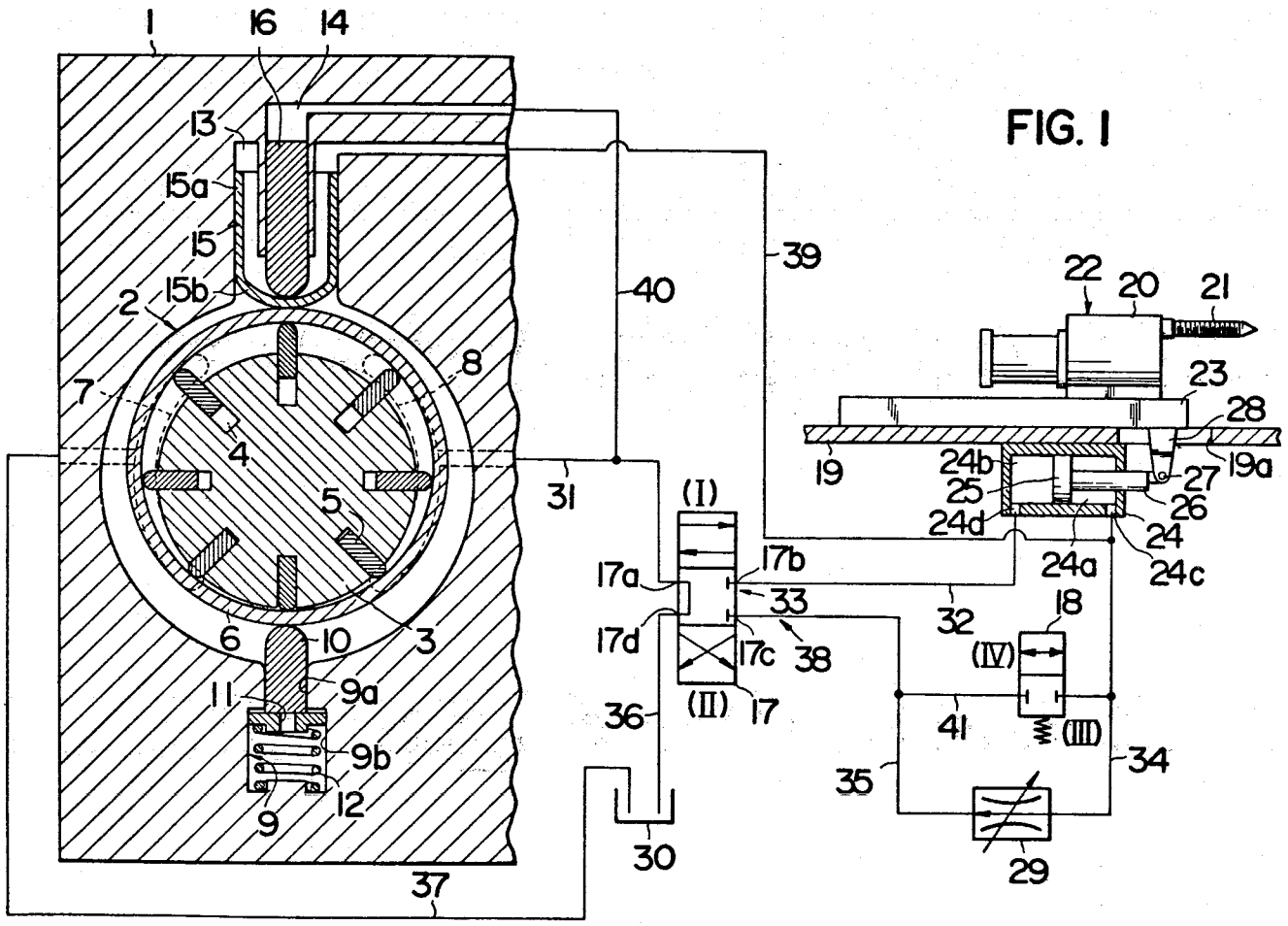
FIG. 1 is a fragmentary cross-sectional view of one embodiment of the hydraulic apparatus embodying the present invention.

Referring now to the drawings and in particular to FIG. 1, there is shown a hydraulic apparatus of the present invention which comprises a casing 1 accommodating therein a variable displacement type vane pump, generally indicated at 2, to change flow rate of pressure oil discharged therefrom. According to the present invention, any other types of variable displacement hydraulic pump such as variable displacement type radial piston pump, variable displacement type axial piston pump or the like may be used in place of the above variable displacement vane pump 2 which is only shown for simplicity of the description about the embodiment of the present invention. The vane pump 2 has a rotor 3 which is rotatably housed in the casing 1 to be driven by an engine through a suitable clutch not shown. A plurality of vane bores 4 are equiangularly formed in the rotor 3 to radially extend and to be opened at their radially outer ends, and each of vane bores 4 is adapted to receive a vane 5 which is urged radially outwardly by a compression coil spring received in the vane bore 4 but not shown. A cam ring 6 is disposed in the casing 1 to surround the rotor 3 in sliding contact with the vanes 5 and eccentrically movable with respect to the rotor 3. Arcuate inlet and outlet ports 7 and 8 are formed in the casing 1 in opposing and spaced relation with each other to be communicated with the inner chamber of the cam ring 6 so that the pressure oil may be introduced into and discharged from the inner chamber of the cam ring 6 through the inlet port 7 and the outlet port 8 by the action of the vanes 5 when the rotor 3 is rotated. A slide bore, generally designated at 9 is radially formed in the casing 1 in perpendicular relation with the rotational axis of the rotor 3 and in opposing relation with the outer peripheral face of the cam ring 6 to have a small diameter portion **9*a* adjacent to the cam ring 6 and a large diameter portion 9*b* remote from the cam ring 6 and larger in diameter than the small diameter portion 9*a*. In the small diameter portion 9*a* of the slide bore 9 is slidably received a slider 10 which has a radially inner end in sliding contact with the outer peripheral face of the cam ring 6. A stop member 11 is also slidably received in the large diameter portion 9*b* of the slide bore 9 to have a radially inner face in abutting relation with the radially outer end of the slider 10. Accommodated in the large diameter portion 9*b* of the slide bore 9 between the stop member 11 and the bottom face of the large diameter portion 9*b* is a compression coil spring 12 which serves to urge the slider 10 toward the cam ring 6 through the stop member 11 so that the cam ring 6 is urged at all times to move in the direction where the eccentricity of the cam ring 6 with respect to the rotor 3 is enlarged, i.e., the flow rate of the vane pump 2 is increased. A first cylinder chamber 13 is formed in the casing 1 at a position opposing to the slide bore 9, and a second cylinder chamber 14 is formed in the first cylinder chamber 13 in coaxial relation with the first cylinder chamber 13. In the present embodiment, the cross-sectional proportion of the first and second cylinder chambers 13 and 14 is designed to be 2 to 1. A first sliding member generally indicated at 15 consists of a cylindrical portion 15***a* and a domed head portion 15*b* integrally formed with the cylindrical portion 15*a*. The first sliding member 15 is slidably received in the first cylinder chamber 13 with the domed head portion 15*b* slidably contacted with the outer peripheral face of the cam ring 6 so as to urge the cam ring 6, upon introduction of the pressure oil into the first cylinder chamber 13, toward the direction where the eccentricity of the cam ring 6 with respect to the rotor 3 is decreased, i.e., the flow rate of the vane pump 2 is decreased. A second sliding member 16 is slidably received in the second cylinder chamber 14 to have a domed head portion 16*a* in contact with the inner face of the domed head portion 15*b* of the first sliding member 15 so that the second sliding member 16 may urge the cam ring 6 through the first sliding member 15, upon introduction of the pressure oil into the second cylinder chamber 14, toward the direction where the eccentricity of the cam ring 6 with respect to the rotor 3 is decreased, i.e., the flow rate of the vane pump 2 is decreased. The reference numeral 17 indicates four ports-three positions directional control valve, while the reference numeral 18 represents two ports-two positions directional control valve. Denoted at 19 is a bed on which a slide table 23 is slidably mounted to have thereon a cutting mechanism 22 with a drill 21 driven by an electric motor 20. A cylinder 24 is attached to the lower side of the bed 19 and has a fore cylinder chamber 24*a* and a rear cylinder chamber 24*b* which are partitioned by a piston 25. A piston rod 26 is integrally formed with the fore face of the piston 25 so that the effective pressurized area of the rear face of the piston 25 may be larger than that of the fore face of the piston 25. In the present embodiment, the effective pressurized area of the rear face of the piston 25 is designed to be double the effective pressurized area of the fore face of the piston 25. The leading end of the piston rod 26 is pivotally connected through a pivotal pin 27 to the lower end of a bracket 28 dependent from the lower face of the slide table 23 to extend throughout a slot 19*a* formed in the bed 19 so that the slide table 23 can be moved forwardly or backwardly on the bed 19 when the piston rod 26 is projected or retracted by the action of the cylinder 24. The reference numerals 29 and 30 respectively indicate a pressure compensated flow control valve and a reservoir tank for storing the oil discharged from the cylinder 24. A first pipe 31 is connected at one end to the outlet port 8 of the vane pump 2 and at the other end to a first port 17*a* of the four ports-three positions directional control valve 17, while a second pipe 32 is connected at one end to a second port 17*b* of the four ports-three positions directional control valve 17 and at the other end to a rear port 24*d* in communication with the rear cylinder chamber 24*b* of the cylinder 24. A first fluid conduit generally designated by the reference numeral 33 and defined in appended claims is constituted as a whole by the first and second pipes 31 and 32 just mentioned. The reference numeral 34 designates a second fluid conduit 34 having one end connected to a fore port 24*c* in communication with the fore cylinder chamber 24*a* of the cylinder 24 and the other end connected to one of ports of the flow control valve 29. A third pipe 35 is connected at one end to the remaining port of the flow control valve 29 and at the other end connected to a third port 17*c* of the four ports-three positions directional control valve 17, while a fourth pipe 36 is connected at one end to a fourth port 17*d* of the four ports-three positions directional control valve 17 and at the other end to the reservoir tank 30. A fifth pipe 37 has one end connected with the inlet port 7 of the vane pump 2 and the other end connected to the reservoir tank 30. A third fluid conduit generally indicated at 38 and defined in appended claims is constituted as a whole by the third, fourth and fifth pipes 35, 36 and 37 previously mentioned. A fourth fluid conduit 39 is connected at one end with the second fluid conduit 34 and at the other end with the first cylinder chamber 13, and a fifth fluid conduit 40 is connected at one end with the first pipe 31 and at the other end with the second cylinder chamber 14. The two ports-two positions directional control valve 18 is provided on a sixth fluid conduit 41 which has one end connected to the second fluid conduit 34 and the other end connected to the third pipe 35.

Figure 4:
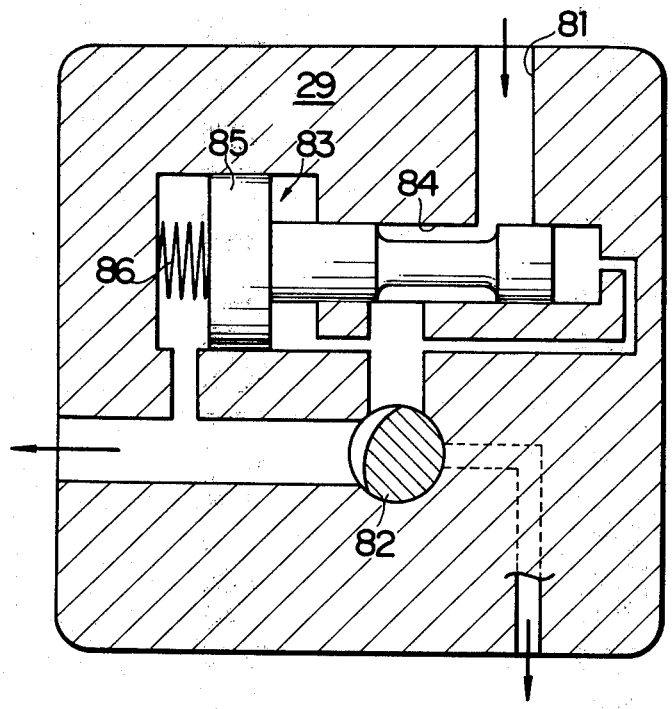
FIG. 4 is a sectional view of the pressure compensated flow control valve used in the present invention.

The previously mentioned pressure compensated flow control valve 29 is particularly shown in FIG. 4 to comprise a passage 81 for permitting the oil to be passed therethrough, a manually operated variable throttling valve 82 provided on the passage 81, and a pressure compensating mechanism 83 provided at the upper stream of the throttle valve 82 on the passage 81. The pressure compensating mechanism 83 includes a cavity 84, a spool 85 slidably received in the cavity 84, and a coil spring 86 resiliently urging at all times the spool 85 in a rightward direction in FIG. 4. If the pressure of the oil introduced into the pressure compensated flow control valve 29 is increased, the spool 85 is moved leftwardly by the pressure of the oil against the coil spring 86 to decrease the cross-section area of the passage 81 so that the pressure loss of the oil passing through the pressure compensating mechanism 83 is increased. If the pressure of the oil introduced into the pressure compensated flow control valve 29 is inversely decreased, the spool 85 is moved rightwardly by the coil spring 86 to increase the cross-section area of the passage 81 so that the pressure loss of the oil passing through the pressure compensating mechanism 83 is decreased. It will therefore be understood that the pressure of the oil is maintained constant between the throttle valve 82 and the pressure compensating mechanism 83 even if the pressure of the oil introduced into the pressure compensated flow control valve 29 is varied, with the result that the flow rate of the oil passing through the throttle valve 82 is maintained constant. The throttle valve 82 is adapted to be manually operated by a suitable handle provided at the outside of the pressure compensated flow control valve 29 to adjust the flow rate of the oil passing therethrough. The previous pressure compensated flow control valve 29 is well known in the art prior to the filing date of the application by such as a publication entitled "Hydraulic appliances and their applied circuits" published by Nikkan Kogyo Shinbunsha, Japan on Oct. 30, 1971 and written by Toshio, Kaneko.

The operation of the hydraulic apparatus as constructed above will now be described hereinlater.

When the rotor 3 is driven by the engine with the cam ring 6 remained at a certain eccentricity thereof, the vane pump 2 sucks the oil from the reservoir tank 30 through the fifth pipe 37 and the inlet port 7 while pressuring and discharging it to the first pipe 31 through the outlet port 8. In order to forwardly move the cutting mechanism 22, the four ports-three positions directional control valve 17 is caused to assume a parallel flow position I, while the two ports-two positions directional control valve 18 is also caused to assume a neutral position III. Under these conditions, the pressurized pressure oil is introduced into the rear cylinder chamber 24b of the cylinder 24 through the first pipe 31 and the second pipe 32 from the vane pump 2 to forwardly move the piston 25 so that the piston rod 26 is projected forwardly, thereby causing the cutting mechanism 22 to be forwardly moved on the bed 19. At this time, the pressure oil in the fore cylinder chamber 24a is discharged into the second fluid conduit 34 and returned to the reservoir tank 30 through the pressure compensated flow control valve 29, the third pipe 35 and the fourth pipe 36. The flow control valve 29 serves to make constant the flow rate of the pressure oil discharged from the fore cylinder chamber 24a of the cylinder 24 since it is provided between the second fluid conduit 34 and the third pipe 35. As a result, the piston 25 is moved at all times at a constant speed, thereby causing the cutting mechanism 22 to be moved also at a constant speed.

Next, the operation of the hydraulic apparatus of the present invention under a load fluctation of the cutting mechanism 22 will now be described hereinafter accompanied by particular values or numerals of the hydraulic apparatus. It is firstly assumed that the flow rate of the flow control valve 29 is 10 (l/min) selected from its flow rate range of 0~10 (l/min), the flow rate of the vane pump 2 is 30 (l/min), the eccentricity of the cam ring 6 with respect to the rotor 3 is 2.5 (mm), and biasing force F of the slider 10 against the cam ring 6, i.e., spring force of the compression coil spring 12 at a time when the eccentricity of the cam ring 6 is 2.5 (mm) is 100 (Kg). It is secondly assumed that the effective pressurized area $A_1$ of the first sliding member 15 is 2 ($cm^2$), the effective pressurized area $A_2$ of the second sliding member 16 is 1 ($cm^2$), the effective pressurized area $B_1$ of the fore face of the piston 25 is 10 ($cm^2$), and the effective pressurized area $B_2$ of the rear face of the piston 25 is 20 ($cm^2$). In order to forwardly move the piston 25 in the actuator 24 at a constant speed during cutting operation of the cutting mechanism 22 for example under the state that a load W of 1600 (Kg) is exerted upon the cutting mechanism 22, a pressure of more than 80 ($Kg/cm^2$) is required since the pressure in the pressure oil within the rear cylinder chamber 24b of the cylinder 24 is exerted by the load at $W/B_2=1600$ (Kg)/20 ($cm^2$)=80 ($Kg/cm^2$). It will become apparent that the value of more than 80 ($Kg/cm^2$) is obtained as the description proceeds. It is thirdly assumed that a pressure in the pressure oil within the rear cylinder chamber 24b of the cylinder 24, i.e., a pressure of the pressurized oil discharged from the vane pump 2 is $P_1$ $Kg/cm^2$ when a load W is exerted upon the cutting mechanism 22. The pressure $P_1$ $Kg/cm^2$ acts upon the second sliding member 16 through the fifth fluid conduit 40, with the result that the second sliding member 16 biases the cam ring 6 against the spring force of the compression coil spring 12 at a force $F_1$ (Kg) which is equal to $P_1$ ($Kg/cm^2$)$\times A_2$ ($cm^2$)$=P_1\times A_2$ (kg). On the other hand, a pressure $P_2$ ($Kg/cm^2$) in the pressure oil within the fore cylinder chamber 24a of the cylinder 24 will be given as follows.

$$P_2(\mathrm{Kg/cm^2}) = [B_2(\mathrm{cm^2}) \times P_1(\mathrm{Kg/cm^2}) - W(\mathrm{Kg})]/B_1(\mathrm{cm^2}) = (B_2 \times P_1 - W)/B_1(\mathrm{Kg/cm^2})$$

Therefore, the first sliding member 15 receives through the fourth fluid conduit 39 a force $F_2$ (Kg) as will be given in the following equation.

$$F_2(\mathrm{kg}) = P_2(\mathrm{Kg/cm^2}) \times A_1(\mathrm{cm^2}) = P_2 \times A_1 = \frac{(B_2 \times P_1 - W)}{B_1} \times A_1$$

It is therefore understood that the first sliding member 15 biases the cam ring 6 against the spring force of the compression coil spring 12 at a force $F_2$ (Kg). Under these conditions, forces acting on the cam ring 6 are brought into being balanced and more specifically the spring force F (Kg) of the compression coil spring 12 is equal to addition of the biasing force $F_1$ (Kg) of the first sliding member 15 against the cam ring 6 and the biasing force $F_2$ (Kg) of the second sliding member 16 against the cam ring 6. The following equations will thus be given.

$$F(\mathrm{Kg}) = F_1(\mathrm{Kg}) + F_2(\mathrm{Kg}) \quad (1)$$
$$= P_1 \times A_2 + \frac{B_2 \times P_1 - W}{B_1} \times A_1$$
$$= P_1 \times 1 + \frac{20 \times P_1 - W}{10} \times 2$$
$$= 5P_1 - \frac{W}{5}$$

Following equations will be given since the load W acting upon the cutting mechanism 22 is 1600 Kg.

$$100 = 5P_1 - \frac{1600}{5} = 5P_1 - 320$$
$$P_1 = 84(\mathrm{Kg/cm^2})$$

It will therefore be understood that the pressure $P_1$ is at all times somewhat larger than the pressure of 80 Kg exerted on the piston 25 by the load W, thereby causing the piston 25 to be forwardly moved at a constant speed even if the load W is fluctuatedly acted on the piston 25.

When a load acting on the cutting mechanism 22 is increased to 1800 (Kg) due to some conditions, the pressure of the pressure oil within the rear cylinder chamber 24b becomes 92 ($Kg/cm^2$) which is obtained from the equation (1). It is thus to be understood that the first sliding member 15 biases the cam ring 6 at a force of 8 (Kg) while the second sliding member 16 also biases the cam ring 6 at a force of 92 (Kg) so that the total force 100 (Kg) comes to be balanced with the spring force 100 (Kg) of the compression coil spring 12. As well be seen from the foregoing description, the forces acting on the cam ring 6 is at all times balanced even if the load acting on the cutting mechanism 22 is fluctuated. As a result, the eccentricity of the cam ring 6 with respect to the rotor 3 is always remained constant, thereby making constant the flow rate of the pressurized oil discharged from the vane pump 2. The constant flow rate of the pressurized oil from the vane pump 2 is made equal to that of the flow control valve 29.

In order to ensure the backward movement of the cutting mechanism 22, the four ports-three positions directional control valve 17 is changed into a cross flow position II from the parallel flow positions I while the two ports-two positions directional control valve 18 is also changed into a flow position IV from the neutral position III. At this time, the pressurized oil discharged from the vane pump 2 is introduced into the fore cylinder chamber 24*a* of the cylinder 24 through the first pipe 31, the third pipe 35, the sixth fluid conduit 41 and the second fluid conduit 34 to cause the piston 25 to be backwardly moved so that the piston rod 26 is retracted to backwardly return the cutting mechanism 22. Simultaneously with the introduction of the pressurized oil into the fore cylinder chamber 24*a* of the cylinder 24, the pressure oil in the rear cylinder chamber 24*b* of the cylinder 24 is discharged into the reservoir tank 30 through the second pipe 32 and the fourth pipe 36. For simplicity of the description about the present embodiment, theoretical calculations have been given assuming that no leakage of the pressure oil is generated between mechanical elements of the hydraulic apparatus according to the present invention, but in actuality some leakage of the pressure oil occurs. It will be appreciated from the foregoing description of the embodiment that the hydraulic apparatus according to the present invention automatically operated to cause the eccentricity of the cam ring 6 to be increased for compensation of the leaked amount of the pressure oil as well as to cause the preset pressure of the compression coil spring 12 to be decreased in response to the leaked amount of the pressure oil.

While it has been described in the foregoing embodiment that the eccentricity of the cam ring 6 is controlled by the compression coil spring 12 and the first and second sliding members 15 and 16, the eccentricity of a thrust ring in the variable displacement type radial piston pump and an inclination angle of a swash plate or a cylinder block shaft in the variable displacement type axial piston pump may be controlled by such resilient member and first and second sliding members. A flow rate changing member defined in appended claims is intended to indicate the cam ring 6 for the vane pump 2, the thrust ring for the variable displacement type radial piston pump, and the swash plate or cylinder block shaft for the variable displacement type axial piston pump.

Figure 2:
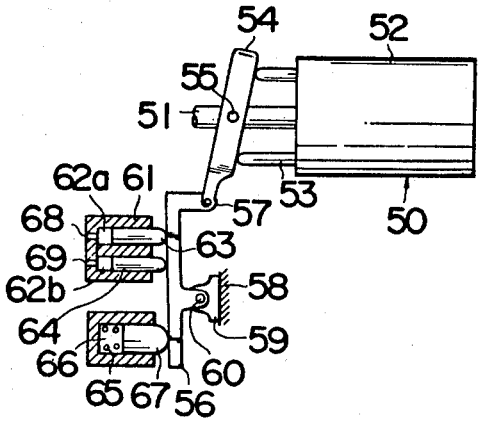
FIG. 2 is a fragmentary cross-sectional view showing another embodiment of the hydraulic apparatus of the present invention with only modified parts.
Figure 3:
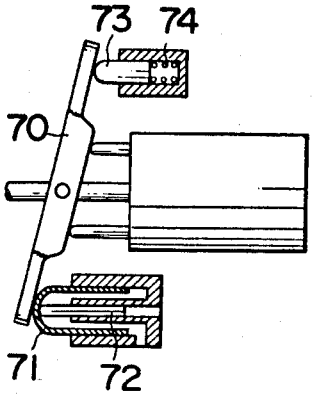
FIG. 3 is a similar view to FIG. 2 but showing still another embodiment of the hydraulic apparatus of the present invention.

With reference to FIGS. 2 and 3, there is shown a variable displacement type axial piston pump on which the hydraulic apparatus of the present invention is applied.

The variable displacement type axial piston pump, generally indicated at 50, is shown in FIG. 2 to comprise a rotary shaft 51, a cylinder block 52 rotatably supported on the rotary shaft 51 and having therein a plurality of cylinders circumferentially equi-spacedly arranged but extending in parallel with the rotary shaft 51, and a plurality of pistons 53 each of which is slidably received in each of the cylinders of the cylinder block 52. A swash plate 54 is pivotally connected at its central portion to the rotary shaft 51 by means of a pivotal pin 55 and is in rolling and sliding contact with the fore ends of the pistons 53 to impart a pumping action to the axial piston pump 50. The lower peripheral portion of the swash plate 54 is pivotally connected by a pivotal pin 57 to one end of a rockable arm 56 which has a longitudinally intermediate portion pivotally connected by a pivotal pin 60 to a bracket 59 secured to a casing 58. A first control casing 61 is disposed in opposing relation with the rockable arm 56 to have therein first and second cylinder chambers 62*a* and 62*b* which are in parallel and spaced relation with each other to extend toward the rockable arm 56 to be opened at the fore face of the first control casing 61 opposing to the rockable arm 56. First and second sliding members 63 and 64 are respectively slidably received in the first and second cylinder chambers 62*a* and 62*b* to have respective fore ends in contact with the rockable arm 56 so that the first and second sliding members 63 and 64 may force the swash plate 54 to decrease the flow rate of the axial piston pump 50 when they are caused to be projected to swing the rockable arm 56 and vice versa. A second control casing 66 is located in opposing relation with the rockable arm 56 and in spaced and parallel relation with the first control casing 61 to have therein a third cylinder chamber 66*a* extending toward the lockable arm 56 and opened at the fore face of the second control casing 66 opposing to the rockable arm 56. A third sliding member 67 is slidably received in the third cylinder chamber 66*a* to have a fore end in contact with the rockable arm 56 and urged toward the rockable arm 56 by means of a compression coil spring 65 accommodated in the third cylinder chamber 66*a* so as to cause the swash plate 54 to increase the flow rate of the axial piston pump 50. The reference numerals 68 and 69 respectively represents fluid conduits which are correspondent to fourth and fifth fluid conduits defined in appended claims and effect the same function as those of the fourth and fifth fluid conduits 39 and 40, respectively.

FIG. 3 shows another variable displacement type axial piston pump in which a swash plate 70 is directly biased by first, second and third sliding members 71, 72 and 73. The first and second members 71 and 72 are arranged in concentrical relation with each other, and the third sliding member 73 is urged by a compression coil spring 74. It will be understood that the axial piston pump shown in FIG. 3 does the same function as that of the axial piston pump shown in FIG. 2. According to the present invention, a closed hydraulic circuit may be used without providing such a reservoir tank as indicated at 30 in FIG. 1, if desired. According to the present invention, any other proportions of the effective pressurized areas of the first and second sliding members 15 and 16 as well as any other proportions of the effective pressurized areas of the fore and rear faces of the piston 25 may be adopted. Further, two rods may be integrally connected to the fore and rear faces of the piston 25. A hydraulic motor may be used in place of the cylinder 24 for forward and backward movements of the cutting mechanism 22 as shown in FIG. 1. Although a pressure compensated flow control valve 29 is assembled in the previously mentioned embodiment, any other flow control valves without pressure compensation may be assembled in the hydraulic apparatus according to the present invention, where desired. A tension coil spring may be used in lieu of the compression coil spring 12 if it is disposed to be able to do the same action as that of the compression coil spring 12. The first and second cylinder chambers 13 and 14 may be arranged in parallel with each other as seen in FIG. 2 in accordance with the present invention.

Although particular embodiments of the present invention have been shown and described, it will be obvious to those skilled in the art that various changes and modifications may be made without departing from the spirit and scope of the present invention.

What is claimed is:

1. A hydraulic apparatus for changing the flow rate by displacing a flow rate changing member of a variable displacement hydraulic pump accommodated in a casing, comprising, in combination: an actuator, a first sliding member slidably received in a first cylinder chamber provided in said casing and movable in one direction to urge said flow rate changing member toward a direction where the flow rate of said hydraulic pump is decreased, a second sliding member slidably received in a second cylinder chamber provided in said casing and movable in said one direction to urge the flow rate changing member toward a direction where the flow rate of said hydraulic pump is decreased, a resilient member accommodated in said casing to resiliently urge said flow rate changing member against a resultant force of said first and second sliding member toward a direction where the flow rate of said hydraulic pump is increased, said resilient member being the only means for urging said first and second sliding members in a direction opposite to said one direction, a first fluid conduit having one end connected with an outlet port of said hydraulic pump and the other end thereof connected with a rear port of said actuator, a second fluid conduit having one end connected with a fore port of said actuator and the other end connected with a port of a pressure compensated flow control valve means for permitting pressure oil passing therethrough to be maintained constant in volume even with variations in pressure of the fluid, a third fluid conduit having one end connected with another port of said flow control valve means and the other end thereof connected with an inlet port of the hydraulic pump, a fourth fluid conduit having one end connected with said second fluid conduit and the other end connected with said first cylinder chamber, and a fifth fluid conduit having one end connected with said first fluid conduit and the other end connected with said second cylinder chamber.

2. A hydraulic apparatus as defined in claim 1, wherein said second cylinder chamber is formed in said first cylinder chamber in coaxial relation with said first cylinder chamber.

3. A hydraulic apparatus as defined in claim 1, wherein said flow rate changing member is a cam ring disposed to surround a rotor in sliding contact with vanes, each of said vanes being slidably received in each of vane bores equiangularly formed in said rotor to radially extend and to be opened at their radially outer ends.

4. A hydraulic apparatus as defined in claim 3, wherein said first and second sliding members are disposed around said cam ring in opposing relation with said resilient member.

5. A hydraulic apparatus as defined in claim 1, wherein said flow rate changing member is a swash plate which is in sliding and rolling contact with a plurality of pistons circumferentially spacedly arranged and slidably received in a cylinder block.

6. A hydraulic apparatus as defined in claim 5, wherein said first and second sliding members are arranged in parallel relation with each other.

7. A hydraulic apparatus as defined in claim 5, wherein said first and second sliding members are arranged in concentric relation with each other.

* * * * *